United States Patent [19]

Speakman

[11] 4,277,200

[45] Jul. 7, 1981

[54] STRUCTURE TO RETARD FRETTING AND METHOD OF MANUFACTURE

[75] Inventor: Eugene R. Speakman, Fullerton, Calif.

[73] Assignee: McDonnell Douglas Corporation, Long Beach, Calif.

[21] Appl. No.: 75,520

[22] Filed: Sep. 13, 1979

[51] Int. Cl.[3] ..... B25G 3/00; F16D 1/00; F16G 11/00; B25G 3/36

[52] U.S. Cl. ..... 403/408; 403/393; 403/404; 252/12; 427/379; 427/388.2; 428/422; 428/461

[58] Field of Search ..... 428/421, 422, 461; 252/12; 427/385.5, 379, 388.2; 403/393, 404, 408

[56] References Cited

U.S. PATENT DOCUMENTS

| | | | |
|---|---|---|---|
| 2,971,908 | 2/1961 | Chaffin | 252/12 |
| 3,002,770 | 10/1961 | Chesnut et al. | 252/12 X |
| 3,434,327 | 3/1969 | Speakman | 151/41.73 X |
| 3,847,826 | 11/1974 | Ivanov | 252/12 |

FOREIGN PATENT DOCUMENTS

| | | | |
|---|---|---|---|
| 798378 | 7/1958 | United Kingdom | 252/12.2 |

OTHER PUBLICATIONS

Benedyk, Joseph C., *Plastic Bearings: An International Survey,* SPE Journal, Apr., 1970, vol. 26, pp. 78–85.

*Primary Examiner*—Michael R. Lusignan
*Attorney, Agent, or Firm*—George W. Finch; Walter J. Jason; Donald L. Royer

[57] ABSTRACT

Fretting caused by movement of adjacent structural members at high stress is prevented by providing a tetrafluoroethylene layer between the moving surfaces. The tetrafluoroethylene may be applied directly to the mating surfaces of parts or on the surfaces of shim stock inserted therebetween.

7 Claims, 7 Drawing Figures

STRUCTURE TO RETARD FRETTING AND METHOD OF MANUFACTURE

BACKGROUND OF THE INVENTION

Whenever surfaces of structural members are placed in contact with each other and subjected to the slightest relative movement, a special form of corrosion takes place. This corrosion makes itself evident by the appearance of irregular patches of black oxide which will occur even when there is very low clamp-up pressure between the members and within the first few cycles of movement. This process is known as fretting corrosion and, if permitted to continue, usually results in a premature fatigue failure of one or both of the structural members. Observations of many fatigue test specimens indicate that fretting damage accounts for at least 30% of the failures and stress corrosion cracks that have been reported on aircraft in service before 50% of the design fatigue life thereof has been expended.

In aircraft structures, fretting fatigue has become the number one failure mode superceding stress corrosion and metal fatigue due to stress concentrations. Interference fasteners and stress coining as shown in U.S. Pat. No. 3,434,327 have reduced stress concentrations about holes in structural elements, whereas the use of overage heat treatment of 7075 T6 to T73 aluminum has reduced stress corrosion in the short transverse grain direction in aluminum. Both of these improvements have been cancelled out by fretting fatigue which is the third and last of the three major failure modes for highly stressed aircraft structural materials such as steel, aluminum and titanium. Many types of coatings, tapes and rub strips have been used to reduce fretting in aircraft structures. They have added cost and weight and are unsatisfactory as they extrude out of a splice joint which reduces the clamp-up of the fastener holding the joint together to cause stress fatigue failure.

Large commercial aircraft now are designed to the latest state-of-the-art by adding material to reduce the stress level and in turn stress concentration factors at the fastener holes. As the service life of these aircraft continues, it is becoming apparent that the added weight increases fretting inside fastener holes and at the faying surfaces of splice joints. Therefore, there has been a need to provide means to prevent or greatly reduce this failure mode so that the expected lifetime of aircraft structures can be extended substantially.

BRIEF DESCRIPTION OF THE PRESENT INVENTION

Faying surfaces are protected from fretting by the present invention by applying tetrafluoroethylene (Teflon) thereto either directly on the faying surfaces, when such is convenient, or to shim stock placed between the faying surfaces when it is not. For example, when parts are small and new, the tetrafluoroethylene normally is applied directly to the faying surfaces thereof and then cured. If the part is 7075 aluminum, the Teflon compound is chosen to have a cure time and temperature which matches the time and temperature for its overage heat treatment. Therefore, the cure and heat treatment can be accomplished at the same time. For rework of parts in service or large parts which are inconvenient to cure, the tetrafluoroethylene is applied to the opposite surfaces of the extremely thin shim stock which is then inserted between the faying surfaces.

The fretting inside holes having fasteners inserted therein with either clearance or interference fit is caused by distortion of the hole under load. Normally, the hole distorts into an oval shape while the fasteners remain cylindrical. High pressure contact areas approximately 45° from the center of the hole cause fretting to initiate fatigue failure off the center line of the hole normal to the applied load. When fasteners having a tetrafluoroethylene coating on their shank portions are employed, this fretting does not occur. The coating also can be applied to the countersink portion of fasteners to reduce fretting in the countersink cavity which normally occurs in aircraft at the end attachments of fuselage splice finger doublers.

It is therefore an object of the present invention to reduce fretting induced fatigue failure in structures, especially aircraft structures.

Another object is to provide a method for reducing fretting fatigue of structures constructed from aluminum, titanium, steel, graphite epoxy and other materials.

Another object is to provide a method for reducing fretting induced fatigue which is adaptable to new structures, large and ungainly structures and old structures.

Another object is to provide a method for reducing fretting fatigue in high strength aluminum structures which includes a heat cured coating which can be cured at the same time that the aluminum is overage heat treated.

Another object is to provide a fretting fatigue prevention method which is adaptable to most areas in an aircraft structure without adding appreciable weight or complexity thereto.

These and other objects and advantages of the present invention will become apparent to those skilled in the art after considering the following detailed specification in conjunction with the accompanying drawings wherein:

DETAILED DESCRIPTION OF THE SHOWN EMBODIMENTS

Figure 1:
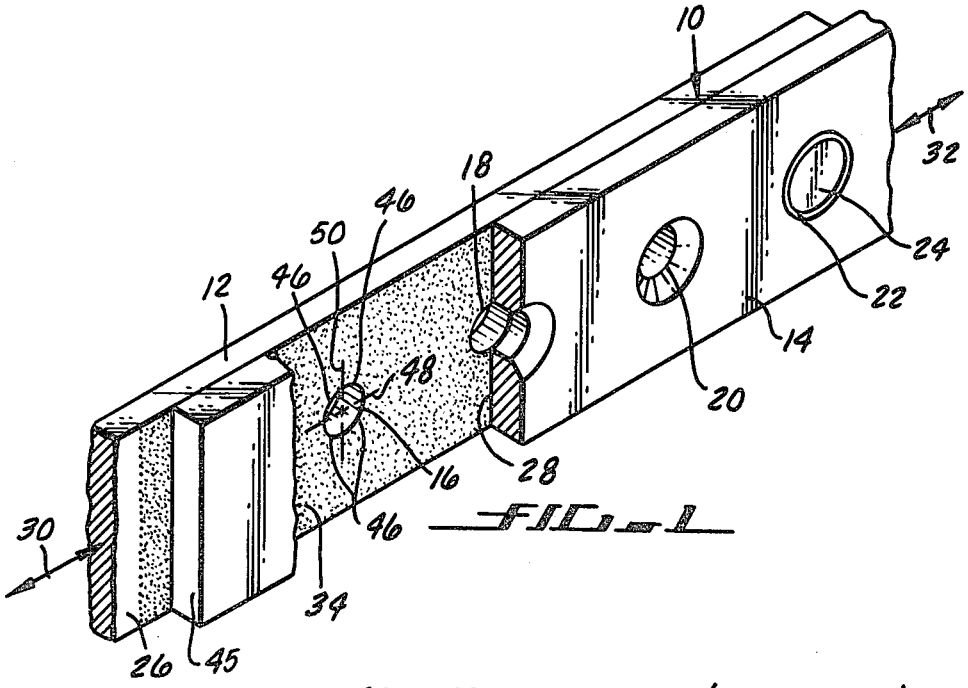
FIG. 1 is partially cutaway view of a structural splice protected from fretting fatigue in accordance with the present invention.

Referring to the drawings more particularly by reference numbers, number 10 in FIG. 1 refers to a spliced structure including first and second structural members 12 and 14 which have a plurality of fastener holes 16, 18, 20 and 22 formed therethrough. Normally, the structure 10 would be held together by a plurality of fasteners placed through the holes 16, 18, 20 and 22 like fastener 24 in hole 22. The fasteners 24 are used to transfer stress between the members 12 and 14 while holding the adjacent surfaces 26 and 28 of the members 12 and 14 tightly together. When loads, such as shown diagramatically by the arrows 30 and 32 are applied to the structure 10, the surfaces 26 and 28 tend to move slightly with respect to each other especially adjacent the end attachments which normally would be placed through holes 16 and 18. The surfaces 26 and 28 become faying surfaces under these conditions and to protect them from fretting fatigue, a thin tetrafluoroethylene layer 34 is applied to one or both surfaces 26 and 28. When the structure 10 is high strength 7075 series aluminum and is a new part, the layer 34 is sprayed thereon and cured at about 350° F. for 8 hours which is the same as the overaging cycle for the aluminum. Therefore both treatments are accomplished at the same time. Tetrafluoroethylene is available which cures in the temperature and time ranges required for the heat treatment of other materials such as steel and titanium also.

Figure 2:
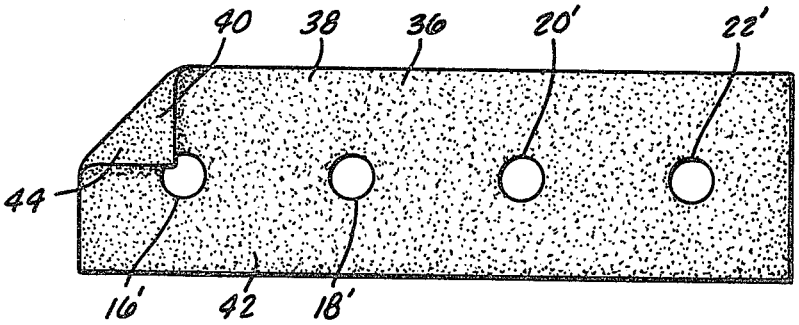
FIG. 2 is an elevational view of a shim constructed according to the present invention to prevent fretting fatigue between two structural members.

When the structure 10 is preexisting or is such that the tetrafluoroethylene layer or layers 34 cannot be conveniently applied thereto, such as when it is large and bulky or when it is constructed from material which does not lend itself to tetrafluoroethylene curing, a shim 36 as shown in FIG. 2 can be employed between the two surfaces 26 and 28. The shim 36 typically is constructed from 0.002 inch thick steel shim stock with ½ to 1 mil thick layers of tetrafluoroethylene 38 and 40 applied to the opposite sides 42 and 44 thereof. Holes 16', 18', 20' and 22' are shown through the shim 36. These normally would be fabricated by placing the shim 36 between the surfaces 26 and 28 prior to the fabrication of the holes 16, 18, 20 and 22 or during clean-up thereof if the structure 10 is an old one. Shims, such as 36 shown in FIG. 2, also are suitable for application between composite structural members such as graphite apoxy since composite materials in some instances have curing cycles which are not compatible with the requirements of sprayed on tetrafluoroethylene.

Fretting also can occur inside the holes 16, 18, 20 and 24 with it most likely to occur in the holes 16 and 18 which are close to the end 45 and therefore subject to additional distortion. The structure 10 when highly loaded tends to cause the holes, such as hole 16, to distort into an oval shape, while the fastener therein remains cylindrical. High pressure contact areas 46 approximately 45° from the center 48 of the hole 16 usually cause fretting to initiate fatigue failure off the center line 50 of the hole 16 normal to the applied load as shown by the arrows 30 and 32. This fretting initiation can be reduced by coating the fasteners retained therein with tetrafluoroethylene as shown in FIGS. 3 and 4.

Figure 3:
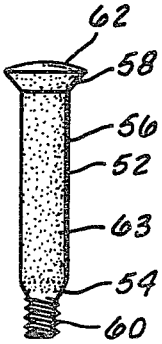
FIG. 3 is a side elevational view of a Hi-Lok type fastener having tetrafluoroethylene applied to its lead-in, shank, and countersink portions.
Figure 4:
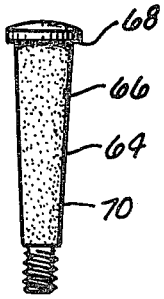
FIG. 4 is a side elevational view of a Taper-Lok fastener having tetrafluoroethylene applied to its shank and underhead portions.
Figure 5:
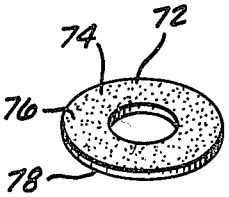
FIG. 5 is perspective view of a washer having tetrafluoroethylene applied to its radial surfaces to prevent fretting corrosion.

The fastener of FIG. 3 is a Hi-Lok fastener 52 having a lead-in radius 54, a cylindrical shank portion 56 and a frustroconcial countersink portion 58. Threads 60 are provided on one end whereas a driving head 62 is provided on the other. The threads 60 and the head 62 are masked and then a tetrafluoroethylene coating 63, ½ to 1 mil thick is applied to the lead-in 54, the cylindrical shank 56 and the frustroconical countersink portion 58. The masking prevents the threads 60 and the head 62 from being coated. This is desirable to enable the finished structure 10 to be painted, which paint will not adhere to tetrafluoroethylene and to allow the nut normally applied to the threads 60 to be locked up by the torque applied thereto. When the coated fastener 52 is installed in a hole like 16, the fretting does not occur and the fatigue life of the structure 10 raises markedly. This is also true with tapered fasteners such as the Taper-Lok fastener 64 shown in FIG. 4 in which the tapered shank portion 66 and the radial underhead surface 68 are similarly coated with a layer of tetrafluoroethylene 70.

In some applications especially sensitive to fretting, washers such as washer 72 can be provided having a tetrafluoroethylene coating 74 similar to the coatings 63 and 70 applied to the opposite radial side surfaces 76 and 78 thereof.

Figure 6:
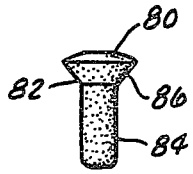
FIG. 6 is a side view of a rivet having tetrafluoroethylene applied to its shank and underhead portions.

The present invention also is adaptable to rivets 80 as shown in FIG. 6. The rivet 80 includes a tetrafluoroethylene coating 82 similar to coatings 63, 70, and 74 on the shank 84 and countersink portion 86 to prevent fretting about the rivet 80 when it is installed. The tetrafluoroethylene coating 82 has proven to be flexible enough to withstand the upset of the rivet 80.

Figure 7:
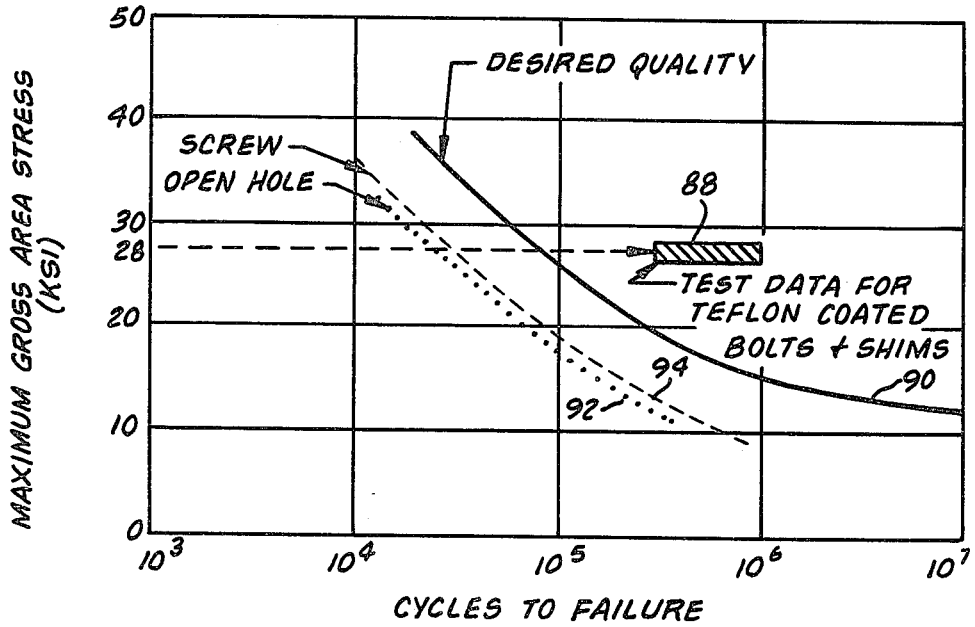
FIG. 7 is a graph of Stress versus Cycles To Failure showing preliminary data documenting the improvement possible utilizing the present invention.

The results attainable with the present invention can be seen in FIG. 7 wherein test data for tetrafluoroethylene coated bolts and shims is shown as the shaded block 88 which is above the line 90 of desired quality. The normal characteristics of an open hole is shown by line 92 and a screw filled hole by line 94.

Thus there has been shown and described a novel method and structure for preventing fatigue failure of the fretting type which fulfills all of the objects and advantages sought therefore. Many changes, modifications, variations and other uses and applications of the subject invention will however become apparent to those skilled in the art after considering the foregoing specification together with the accompanying drawings. All such changes, modifications, variations and other uses and applications which do not depart from the spirit and scope of the invention are deemed to be covered by the invention which is limited only the claims which follow.

What is claimed is:

1. A structure constructed to reduce fretting fatigue including:

a first member being a shim having first and second opposite surfaces thereon, said first surface having a tetrafluoroethylene coating thereon;

a second member having a first surface thereon in contact with said tetrafluoroethylene coating of said first surface of said first member;

a third member having a first surface which faces toward said first surface of said second member and is held in contact with said second surface of said first member; and fastener means to hold said first, second, and third members in contact whereby loads are transmitted between said first and third members with reduced fretting levels at said first surfaces thereof.

2. The structure as defined in claim 1 wherein said first member shim second surface has a tetrafluoroethylene coating thereon, said third member first surface which faces toward said first surface of said second member being held in contact with said tetrafluoroethylene coating of said second surface of said first member.

3. A structure constructed to reduce fretting fatigue including:

a fastener having a shank, said shank having a tetrafluoroethylene coating thereon;

a second member capable of being subjected to loads having an inner surface of a hole defined therein in contact with said tetrafluoroethylene coating of said shank so that fretting therebetween is reduced.

4. A structure comprised of at least first and second structural elements each having a surface that faces the other, said first and second structural elements being held together by fastener means and being subjected to fluctuating stresses which normally would induce fretting between said facing surfaces thereof and a thin layer of tetrafluoroethylene attached between said facing surfaces to reduce fretting therebetween.

5. The structure as defined in claim 3 wherein said fastener includes a head portion with an underside surface thereon, said underside surface having a tetrafluoroethylene coating thereon in contact with said inner surface defined in said second member so that fretting therebetween is reduced.

6. The structure as defined in claim 5 wherein said fastener is a rivet.

7. The structure as defined in claim 4 wherein said first member is a washer having a second surface with a tetrafluoroethylene coating thereon.

* * * * *